US006782951B2

(12) United States Patent
Taylor et al.

(10) Patent No.: US 6,782,951 B2
(45) Date of Patent: Aug. 31, 2004

(54) FLOW-ACTIVATED VALVE AND METHOD OF USE

(76) Inventors: Jeff L. Taylor, 100 Lynwood Dr., Houma, LA (US) 70360; Mark A. Taylor, 104 Jennifer Cir., Houma, LA (US) 70360

( * ) Notice: Subject to any disclaimer, the term of this patent is extended or adjusted under 35 U.S.C. 154(b) by 0 days.

(21) Appl. No.: 10/143,696

(22) Filed: May 8, 2002

(65) Prior Publication Data

US 2003/0209349 A1 Nov. 13, 2003

(51) Int. Cl.[7] ..... E21B 31/113; E21B 34/14

(52) U.S. Cl. ..... 166/374; 166/301; 166/381; 166/319; 166/177.6; 166/332.1

(58) Field of Search ..... 166/319, 334.1, 166/332.1, 381, 374, 301, 178, 177.6

(56) References Cited

U.S. PATENT DOCUMENTS 3,651,867 A * 3/1972 Baumstimler ..... 166/99
3,831,677 A * 8/1974 Mullins ..... 166/128
4,179,002 A * 12/1979 Young ..... 175/297
4,333,542 A 6/1982 Taylor
4,403,659 A * 9/1983 Upchurch ..... 166/374
4,462,471 A * 7/1984 Hipp ..... 175/296
4,844,157 A 7/1989 Taylor
4,849,273 A 7/1989 Skinner et al.
4,889,198 A 12/1989 Buck
4,919,219 A 4/1990 Taylor
4,979,561 A * 12/1990 Szarka ..... 166/240
5,022,473 A 6/1991 Taylor
5,069,282 A 12/1991 Taylor
5,085,479 A 2/1992 Taylor
5,219,027 A 6/1993 Taylor
5,269,374 A 12/1993 Taylor
5,335,731 A * 8/1994 Ringgenberg et al. ..... 166/336
5,337,829 A 8/1994 Taylor
5,381,862 A * 1/1995 Szarka et al. ..... 166/212
5,474,128 A * 12/1995 Bitting ..... 166/242.7
5,673,754 A 10/1997 Taylor
6,182,775 B1 * 2/2001 Hipp ..... 175/296
6,308,779 B1 * 10/2001 McNeilly et al. ..... 166/301
6,378,612 B1 * 4/2002 Churchill ..... 166/319
6,533,037 B2 * 3/2003 Eslinger et al. ..... 166/319

* cited by examiner

*Primary Examiner*—David Bagnell
*Assistant Examiner*—Shane Bomar
(74) *Attorney, Agent, or Firm*—Roy, Kiesel, Keegan & DeNicola

(57) ABSTRACT

According to the present invention, the flow-activated valve assembly is a fluid-driven tool for use in various down hole drilling and fishing operations, which is activated by the introduction of fluid into an enclosed assembly, whereby fluid forces a movable portion of such assembly to slide until it engages a stationary portion, where an impact is realized, and at which time the fluid is permitted to exhaust. Upon this impact, another valve is opened to permit fluid to flow in another channel, moving the assembly in the opposite direction until it reaches a second stationary portion, at which point another impact is realized in the opposite direction. This creates a bi-directional hammering effect for each cycle of the tool, which can be utilized in various applications, either for the jarring effect, the linear motion, or a combination of both.

18 Claims, 6 Drawing Sheets

FLOW-ACTIVATED VALVE AND METHOD OF USE

BACKGROUND OF THE INVENTION

The present invention relates to downhole fishing and drilling operations, or retrieving obstructions to a drilling line when such a line becomes lodged or otherwise stuck in the well bore. Conventional means of downhole retrieval are dubious, and usually involve attempting to actuate the entire work string in the hope of dislodging it or removing an obstruction. Often this is unsuccessful either because the work string cannot jar loose the obstructions, or adequate motion cannot be effected in the well bore. Consequences of this failure to remove the obstruction can be failure of the well to produce at all or in part, also, older methods of removing obstructions can result in line breakage, both of which result in having to relocate the drilling operation, which necessarily involves lost time and money.

The present invention is able to attempt to actuate a lodged object in the path of the drilling path without moving the work string, which results in reduced trauma and friction and prevents work-hardening of the work string. The tool can also have various other applications, such as drilling, retrieving or driving other tools that may be attached to it, or in any application, down hole or otherwise, that may require such a jarring or oscillating action.

OBJECTS OF THE INVENTION

One objective of this invention is to provide a device capable of maintaining tensile force on a drilling work string while dislodging an object that may be interfering with the well operation.

Another objective of the invention is to provide a device that is more efficient at dislodging obstructions interfering with well operations.

Still another objective of the invention is to provide a device that can be placed into any confined space and perform a jarring action, or drive other tools that require linear input.

Other objects and advantages of this invention shall become apparent from the ensuing descriptions of the invention.

SUMMARY OF THE INVENTION

According to the present invention, the flow-activated valve assembly is a fluid-driven tool for use in various down hole drilling and fishing operations, which is activated by the introduction of fluid into an enclosed assembly, whereby fluid forces a movable portion of such assembly to slide until it engages a stationary portion, where an impact is realized, and at which time the fluid is permitted to exhaust. Upon this impact, another valve is opened to permit fluid to flow in another channel, moving the assembly in the opposite direction until it reaches a second stationary portion, at which point another impact is realized in the opposite direction. This creates a bi-directional hammering effect for each cycle of the tool, which can be utilized in various applications, either for the jarring effect, the linear motion, or a combination of both.

DESCRIPTION OF THE DRAWINGS

The accompanying drawings illustrate an embodiment of this invention. However, it is to be understood that this embodiment is intended to be neither exhaustive, nor limiting of the invention. It is but one example of some of the forms in which the invention may be practiced.

DETAILED DESCRIPTION OF THE PREFERRED EMBODIMENT

Without any intent to limit the scope of this invention, reference is made to the figures in describing the preferred embodiments of the invention. Referring to FIGS. 1 through 3, FIGS. 1A through 1C show the invention in the "down" or "re-cock" position. FIGS. 2A through 2C show the invention in the "up" or "fired" position, and FIGS. 3A through 3C show the invention in the "neutral" or "ready to fire" position.

Figure 1A:
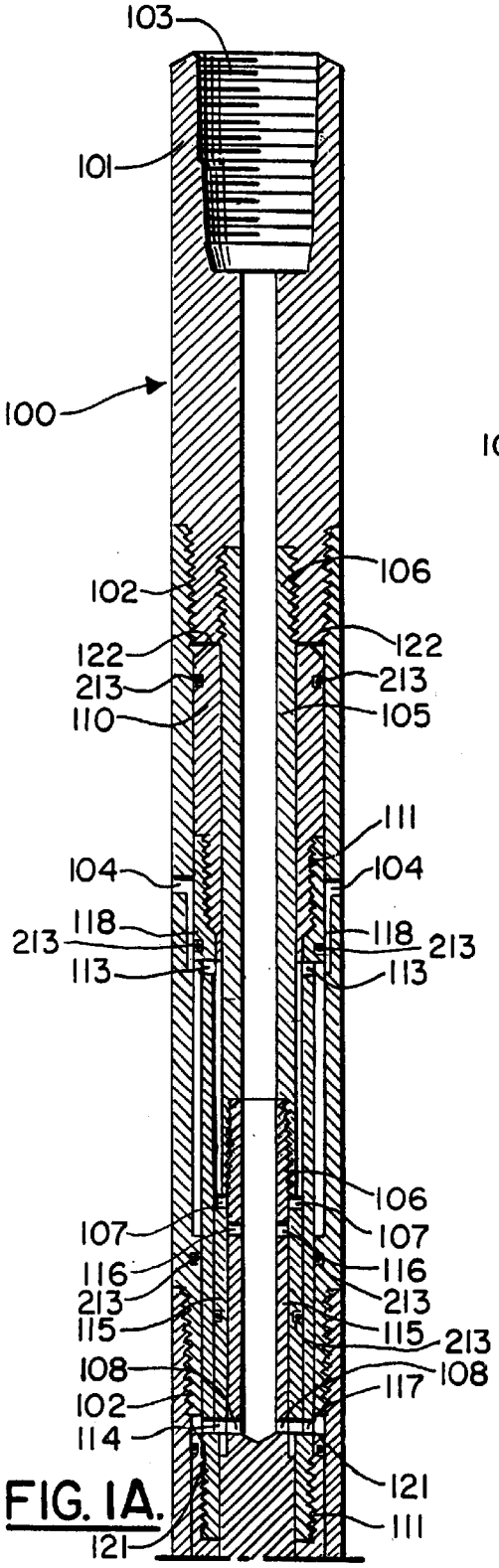
FIGS. 1A–1C show diametrical longitudinal cross-sections of the flow-activated valve assembly in the "up" or "fired" position.
Figure 1B:
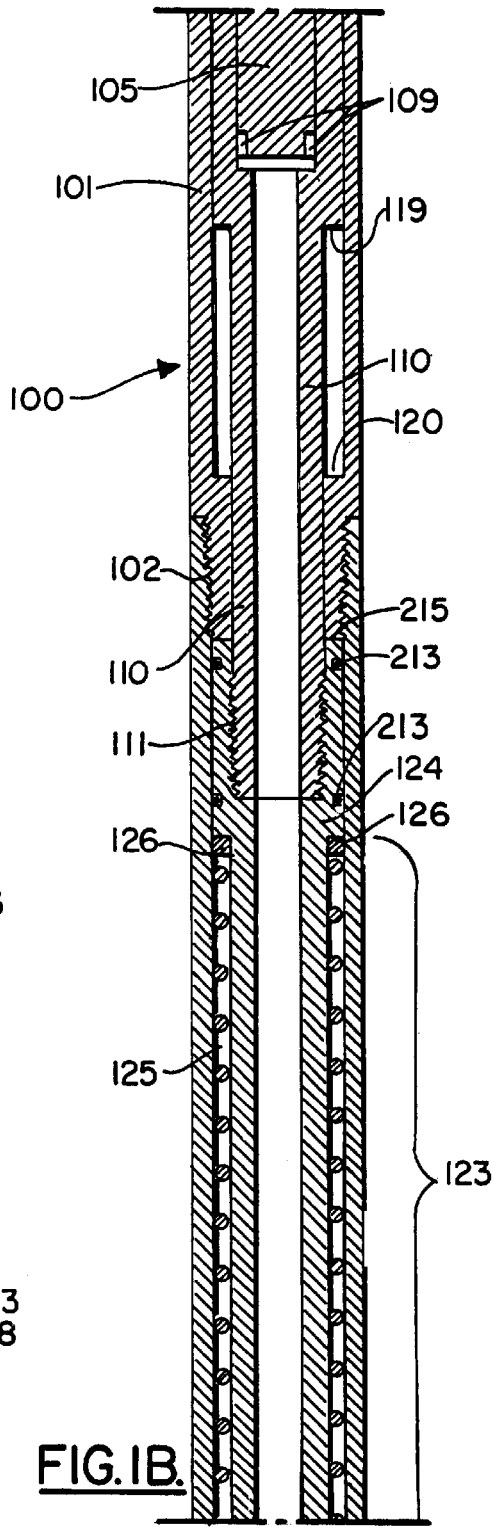
Figure 1C:
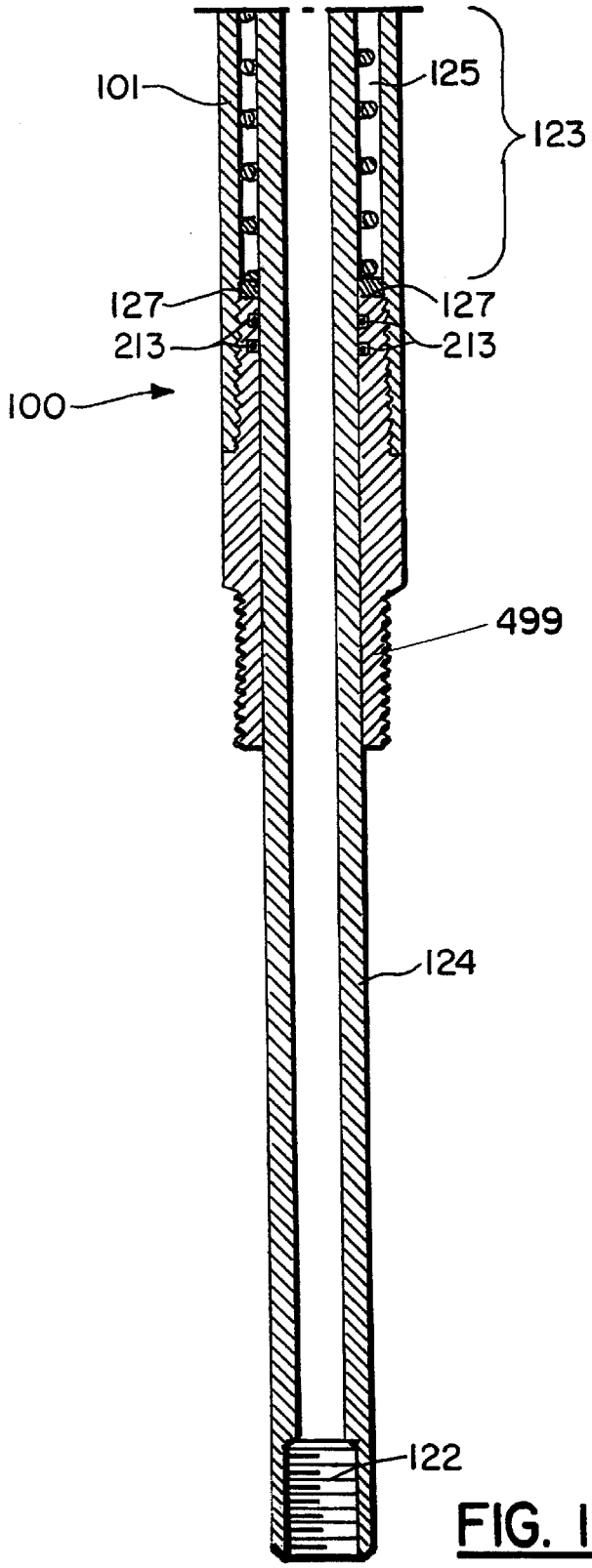
Figure 2A:
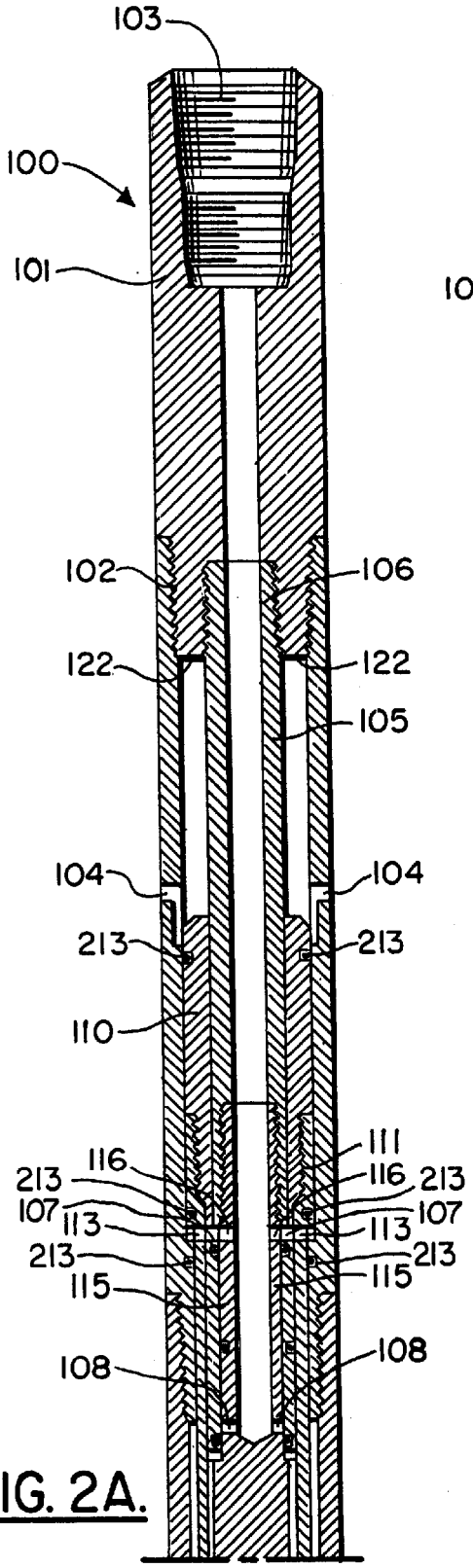
FIGS. 2A–2C show diametrical longitudinal cross-sections of the flow-activated valve assembly in the "down" or "re-cock for firing" position.
Figure 2B:
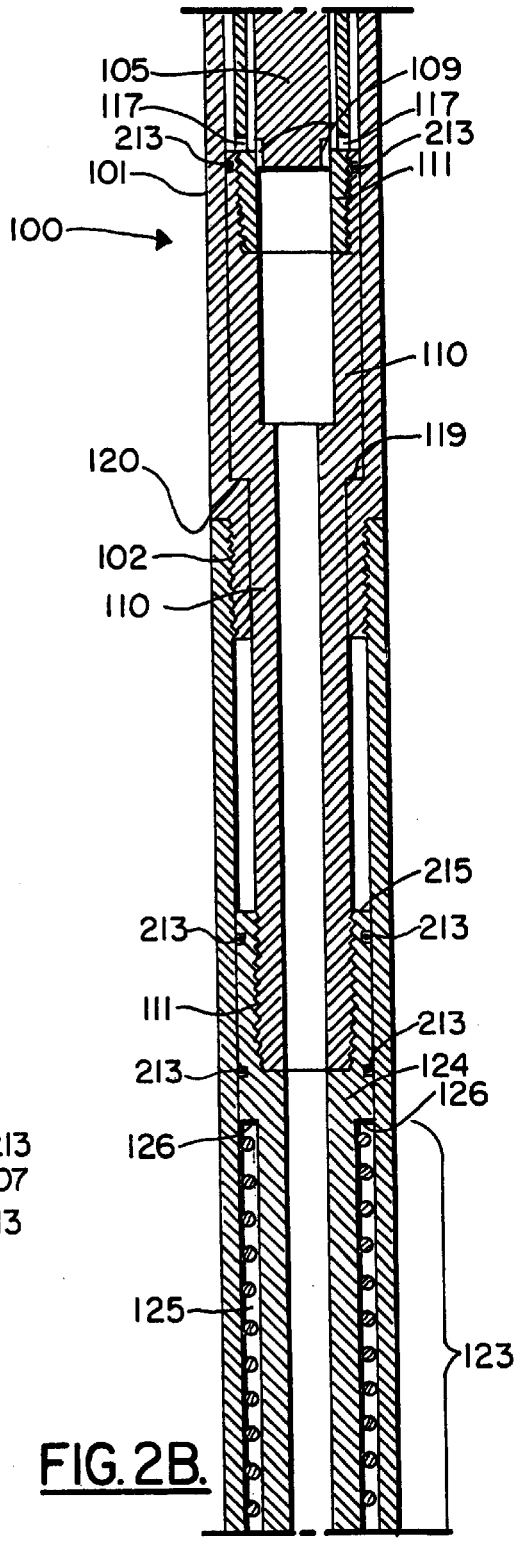
Figure 2C:
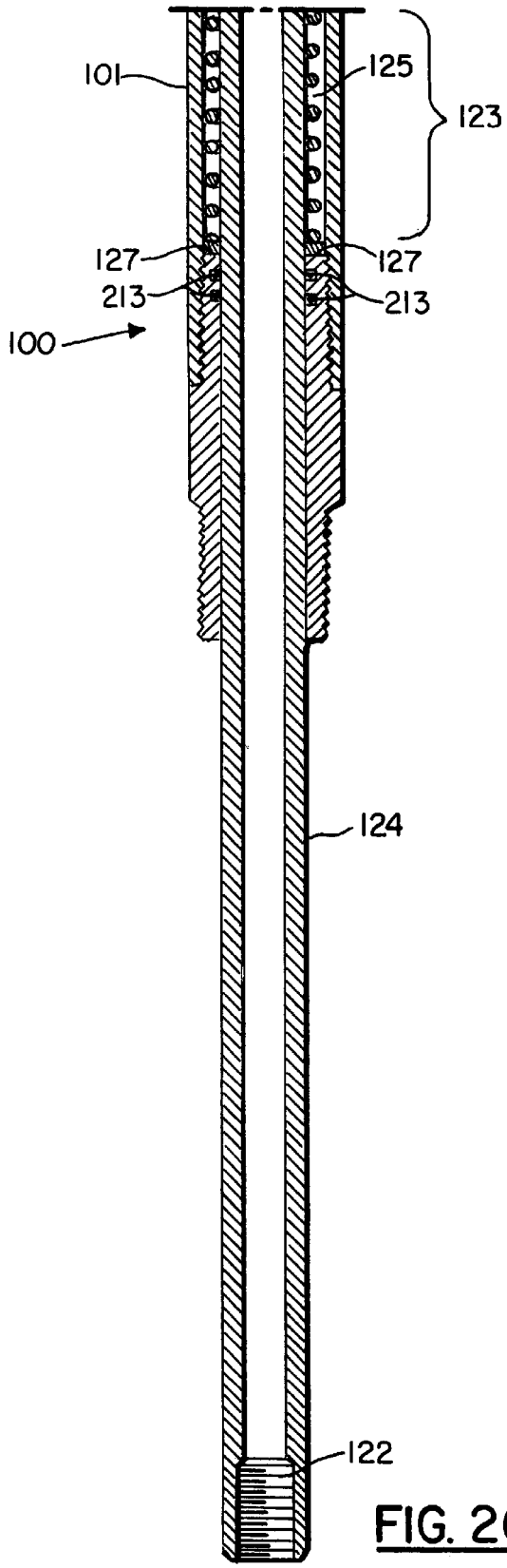
Figure 3A:
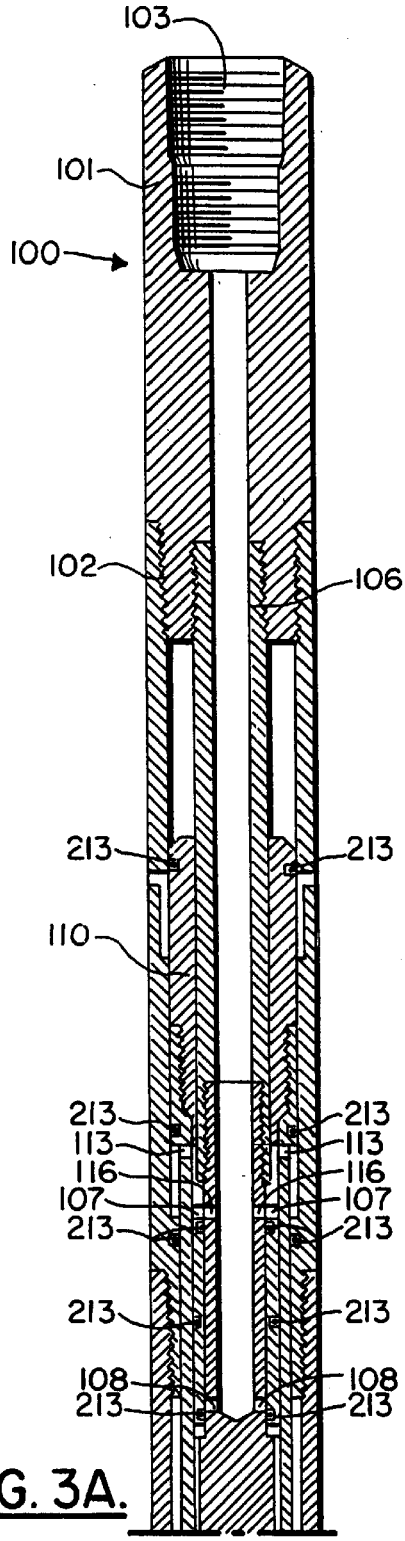
FIGS. 3A–3C show diametrical longitudinal cross-sections of the flow-activated valve assembly in the "neutral" or "ready to fire" position.
Figure 3B:
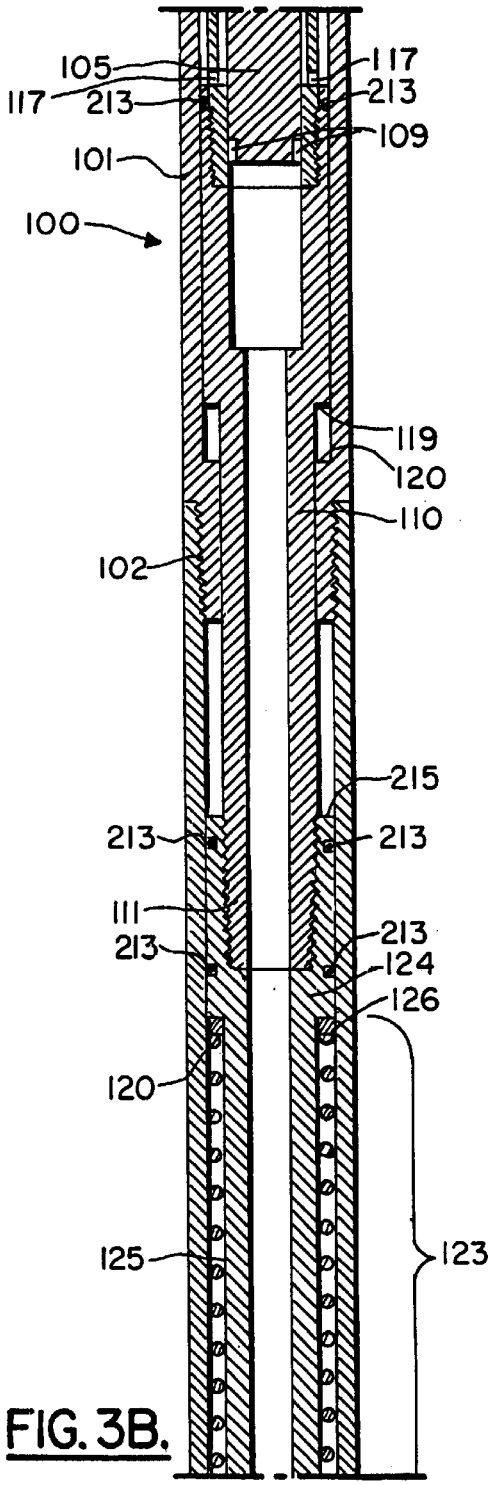
Figure 3C:
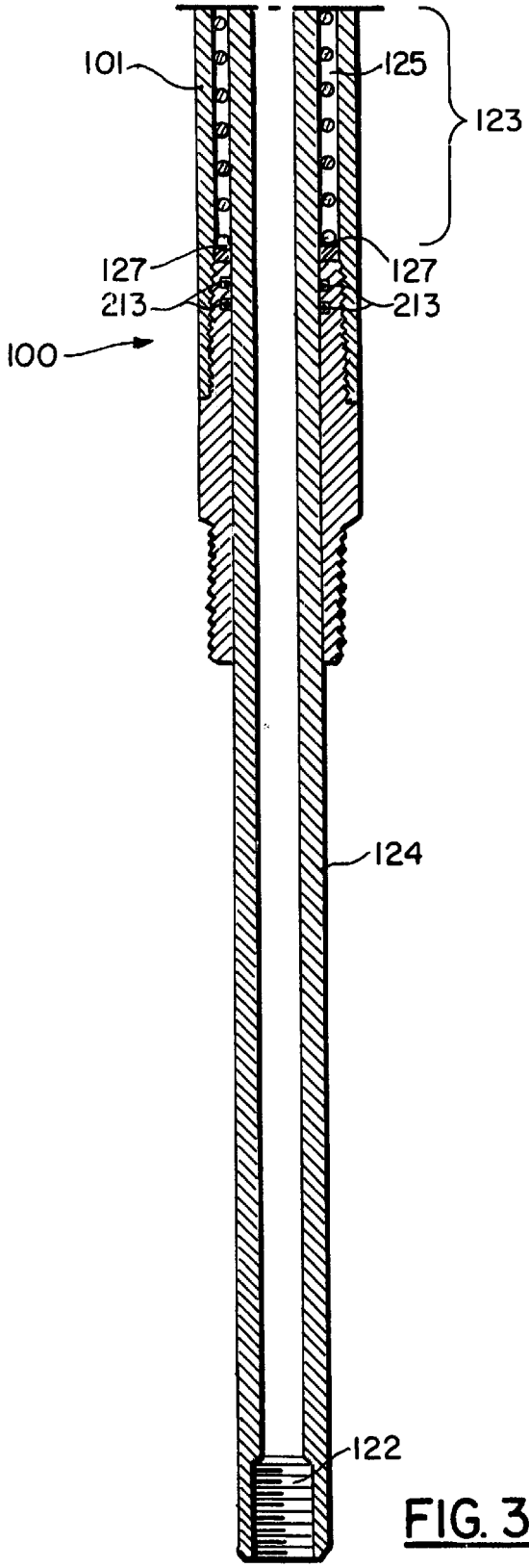

The "top" of tool assembly 100 starts at the top of FIG. 1A, 2A, and 3A. Shown is outer mandrel 101, which in the embodiment of the above-mentioned FIGS., is threadably separable into several parts to facilitate assembly and maintenance by way of several threaded joints 102. The tool assembly 100 is shaped to permit connection to a hydraulic source and/or other threaded tool at joint 103. Outer mandrel 101 also has hydraulic exhaust ports 104. Located within outer mandrel 101 is the inner mandrel 105, which, in this embodiment, is threadably attached to outer mandrel 101 and is separable into parts by way of threaded connections 106. Inner mandrel 105 has hydraulic fore exhaust ports 107 and aft exhaust ports 108. Hydraulic fluid is also able to exhaust at the lower end of inner mandrel 105 through mill slots 109. These parts are all stationary while the tool is being operated.

Some of the parts of tool assembly 100 are moving while tool assembly 100 is operated, the first of which is reciprocating valve 110. Like outer mandrel 101 and inner mandrel 105, reciprocating valve 110 has, in the embodiment shown, been cast as separable pieces joined by threadable connections 111. Reciprocating valve 110 has fore hydraulic exhaust ports 113 and aft hydraulic exhaust ports 114. Various shoulders are along reciprocating valve 110 and its path of travel, such as aft hammer shoulder 119, which engages fore inner shoulder 120 of outer mandrel 101 on the down stroke. There also exists a reciprocating sleeve closing shoulder 118, and a reciprocating sleeve opening shoulder 121 which is used to actuate reciprocating sleeve 115 during operation. Outer mandrel 101 has a top shoulder 122 where outer mandrel 101 joins inner mandrel 105. Another moving part, reciprocating sleeve 115 is mounted to engage the outer portion of inner mandrel 105, and to slide back and forth along a small portion of inner mandrel 105. As in reciprocating valve 110, reciprocating sleeve 115 has fore hydraulic exhaust ports 116 and aft hydraulic exhaust ports 117.

It should be recognized that various threadable connections 111, while shown, are not essential for proper operation, and the invention can be practiced with or without threadable connections 111 on reciprocating valve 110, outer mandrel 101, or inner mandrel 105. Parts may be cast in fewer or more pieces, depending upon need and adoption for a particular use. In any embodiment, o-rings 213 may be strategically placed throughout the tool to prevent fluid or other materials that may be passing through or around the tool from entering moving part areas of the tool. An example of such a component is outer mandrel coupling 499.

During operation, driving fluid, such as hydraulic fluid, gas or similar, is pumped or otherwise introduced into tool assembly 100 at joint 103. The fluid then passes within outer mandrel 101, to inner mandrel 105, and while tool assembly 100 is in the "up" position, the fluid will exit via aft hydraulic ports 108 of inner mandrel 105, aft hydraulic ports 114 of reciprocating sleeve 115 and aft hydraulic ports 117 of reciprocating valve 110, at which point the fluid will force reciprocating valve 110 to move away from the "top" of tool assembly 100. Eventually, reciprocating valve 110 will engage aft hammer shoulder 119, creating an impact in the downward direction, as well as marking the end of the downward stroke.

Simultaneously with the above action, reciprocating sleeve opening shoulder 121 of reciprocating valve 110, as it slides, will cause reciprocating sleeve 115 to move down the inner mandrel 105 in the same direction, effectively closing aft hydraulic ports 108 of inner mandrel 105, and opening fore hydraulic ports 107 of inner mandrel 105. At this time, the fluid will be permitted to exit via the lower end of inner mandrel 105 through mill slots 109, at which point it may exit from end 122. This leaves tool assembly 100 in the "down" position.

At all times during operation, additional fluid is being pumped into joint 103, but because inner mandrel 105 hydraulic aft exhaust ports 108 are now closed, the fluid exits through the inner mandrel 105 hydraulic fore exhaust ports 107, which forces reciprocating valve 110 to move in the direction of joint 103 due to fluid pressure being applied to reciprocating valve 110, that being the path of least resistance. This movement continues until reciprocating valve 110 reaches top shoulder 122, at which point reciprocating valve 110 engages top shoulder 122 and creates an impact in an upward direction, marking the end of the upward stroke. At this point, reciprocating valve 110 will have traveled far enough to expose outer mandrel's 101 hydraulic exhaust ports 104 so that fluid will exit tool assembly 100. When reciprocating valve 110 is in this position, reciprocating sleeve closing shoulder 118 will have moved reciprocating sleeve 115 to its original, or "up" position, thus restarting the cycle.

To assist in the down hole operation, accelerator 123 may be attached to bottom end of tool assembly 100 in order to exaggerate the vibratory motion created by tool assembly 100. Accelerator 123 is constructed of extending mandrel 124, which is shaped to fit within outer mandrel 101, but also to permit a compressible kinetic energy sleeve 125 to fit between the walls of outer mandrel 101 and extending mandrel 124, and further be connected to reciprocating valve. Kinetic energy sleeve 125 is retained in place by being situated between a fore accelerator shoulder 126 and an aft accelerator shoulder 127.

In this manner, when reciprocating valve 110 is performing a downward stroke, it is energizing a compressible kinetic energy sleeve 125, such as a spring, belleville washer assembly, stacked chevron washer assembly, risked washer springs, hydraulic fluid or other known similar devices. This is accomplished when fore accelerator shoulder 126 is moving downwardly and compresses kinetic energy sleeve 125. When reciprocating valve 110 reverses direction, it is thrust forward with the contained kinetic energy stored in compressible kinetic energy sleeve 125, thus creating a more powerful impact on the upstroke. Similarly, compressible kinetic energy sleeve 125 can be configured to have the reverse effect, or to amplify the downward stroke. This can be done by reversing compressibility of the spring to change the direction of the release of kinetic energy.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A flow-activated valve assembly comprising:

a. an outer mandrel adapted to be operatively engaged to provide mechanical communication with a work string and having an internal diameter capable of permitting any fluid to flow through it;

b. a reciprocating valve shaped to fit within said outer mandrel;

c. an inner mandrel shaped to fit within said reciprocating valve and operatively engaged on one end to said outer mandrel in order to maintain relative position to said outer mandrel and having an internal diameter capable of permitting any fluid to flow into it;

d. a reciprocating sleeve shaped to engage a portion of the surface forming the outer diameter of said inner mandrel; and e. a plurality of relief ports fore and aft configured in said inner mandrel to permit the escape of said fluid flowing therein.

2. The flow-activated valve assembly of claim 1 wherein said reciprocating sleeve is configured to selectively control the flow of said fluid out of said relief ports of said inner mandrel by longitudinally sliding over and closing said fore and aft relief ports in a mutually exclusive manner.

3. The flow-activated valve assembly of claim 2 wherein when said reciprocating sleeve closes said aft relief ports, said fluid is permitted to flow out of said fore relief ports, forcing said reciprocating valve to move in a direction diametrically opposed to the start of said work string.

4. The flow-activated valve assembly of claim 3 wherein said reciprocating valve has fore and aft valve relief ports.

5. The flow-activated valve assembly of claim 4 wherein said outer mandrel further comprises shoulders on the surface forming the inner diameter of said outer mandrel.

6. The flow-activated valve assembly of claim 5 wherein said reciprocating valve is engaged inside said outer mandrel in a manner that permits longitudinal movement within said outer mandrel to upper and lower extremes of longitudinal movement at which said reciprocating valve will abut said shoulders located on the surface forming the inner diameter of said outer mandrel, thus limiting its motion and causing an impact.

7. The flow-activated valve assembly of claim 6 wherein at its uppermost position, said reciprocating valve slidably engages said reciprocating sleeve opening said fore valve relief port to permit fluid to flow out and to force said reciprocating valve in a direction diametrically opposed to the start of said work string.

8. The flow-activated valve assembly of claim 7 wherein at its lowest position, said aft valve relief port will be open, to permit fluid to flow out and to force said reciprocating valve in a direction toward the start of said work string.

9. The flow-activated valve assembly of claim 8 wherein said reciprocating valve has valve relief ports, whereby fluid is permitted to exhaust when said inner mandrel has reached its lowest position and the walls of said inner mandrel no longer impede the flow of liquid through said valve relief ports.

10. The flow-activated valve assembly of claim 9 wherein said outer mandrel has upper exhaust ports which permit the exhaust of said fluid when said reciprocating valve is in its lowest position.

11. The flow-activated valve assembly of claim 10 further comprising an accelerator mandrel having an inner diameter capable to of permitting any fluid to flow through it.

12. The flow-activated valve assembly of claim 11 wherein said accelerator mandrel is operatively engaged to said reciprocating valve in order to permit concurrent motion.

13. The flow-activated valve assembly of claim 12 further comprising a kinetic energy sleeve shaped to operatively engage said accelerator mandrel to provide directed energy.

14. The flow-activated valve assembly of claim 13 further comprising an outer mandrel coupling, engaged to said outer mandrel and shaped to decrease the inner diameter of said outer mandrel and forming a kinetic energy sleeve aft shoulder at said engagement with said outer mandrel.

15. The flow-activated valve assembly of claim 16 further comprising a wherein said kinetic energy sleeve shaped to operatively engage a substantial portion of the surface forming the outer diameter of said accelerator mandrel providing slidable communication, and which abuts said kinetic energy sleeve aft shoulder.

16. The flow-activated valve assembly of claim 15 wherein portion of said accelerator mandrel nearest said reciprocating valve is shaped to fit within said outer mandrel, and the remaining portion of said accelerator mandrel is shaped to fit within said kinetic energy sleeve, forming a kinetic energy sleeve fore shoulder which engages one end of said kinetic energy sleeve.

17. A flow-activated valve assembly comprising:

I. An outer body and stationary mandrel assembly comprising:

a. A top housing having a cylindrical body forming a cavity, having opposite ends;

b. A lower valve body operatively engaged to said top housing to maintain relative position having a cylindrical body with opposite ends and forming a cavity;

c. An upper valve body operatively engaged to said lower valve body to maintain mechanical communication, having a cylindrical body with opposite ends and forming a cavity and having a plurality of bores drilled through the body;

d. An upper stationary valve mandrel operatively engaged with said top housing to provide mechanical communication, with a cylindrical body forming a cavity having opposite ends;

e. A lower stationary valve mandrel operatively engaged to said upper stationary valve mandrel to maintain mechanical communication, having opposite ends, with first end having a cavity extending though a portion of the first opposite end, the closed end of said cavity having four bores each ninety degrees from the next, from within the cavity through the wall of said mandrel, whereby fluid may flow through said bores; the open end of said cavity having proximate to it another set of bores extending from the inside of said cavity to through the wall of said lower stationary valve mandrel, second end of said lower stationary valve mandrel having grooves cut longitudinally to permit the flow of fluid past said second end of said lower stationary valve mandrel;

II. An inner mandrel assembly shaped to fit within said outer body assembly, comprising:

a. An upper valve mandrel with a cylindrical body forming a cavity having opposite ends;

b. A middle valve mandrel operatively engaged to said upper valve mandrel to maintain mechanical communication, with a cylindrical body forming a cavity having opposite ends, first opposite end being of larger diameter than the body of said middle valve mandrel, and where change in diameter of said middle valve mandrel occurs, said middle valve mandrel having a plurality of bores extending through said wall of said middle valve mandrel into said cavity, and proximately located to the said first opposite end of said middle valve mandrel, a plurality of bores;

c. A lower valve mandrel operatively engaged to said upper valve mandrel to maintain mechanical communication with a cylindrical body forming a cavity having opposite ends, first opposite end having threads on the surface forming its outer diameter for attachment and operatively engaged to said upper valve mandrel to maintain mechanical communication and second opposite end being operatively engaged to an accelerator to maintain mechanical communication; said second end of said lower valve mandrel shaped to operatively receive said second opposite end of said lower stationary valve mandrel to maintain mechanical communication;

d. An exhaust piston with a cylindrical body forming a cavity shaped to receive said lower stationary valve mandrel within the surface forming its outer diameter permitting longitudinal movement along said lower stationary valve mandrel and having opposite ends, said opposite ends having a plurality of mill slots, for hydraulic fluid to pass through.

18. The method of exerting a vibratory force to any obstruction via a down hole tool using a flow-activated valve assembly comprising: an outer mandrel adapted to be operatively engaged to provide mechanical communication with a work string and having an internal diameter capable of permitting any fluid to flow through it, a reciprocating valve shaped to fit within said outer mandrel, an inner mandrel shaped to fit within said reciprocating valve and operatively engaged on one end to said outer mandrel to maintain relative position to said outer mandrel and having an internal diameter capable of permitting any fluid to flow into it, a reciprocating sleeve shaped to engage a portion of the surface forming the outer diameter of said inner mandrel and a plurality of relief ports fore and aft configured in said inner mandrel to permit the escape of said fluid flowing therein, the method comprising:

attaching said flow-activated valve assembly to a work string;

placing said work string against an obstruction; and pumping fluid into said flow-activated valve assembly.

* * * * *